US006224346B1

(12) United States Patent
Denenburg

(10) Patent No.: US 6,224,346 B1
(45) Date of Patent: May 1, 2001

(54) FLUID PUMP

(75) Inventor: Igor Denenburg, Rehovot (IL)

(73) Assignee: Medimop Medical Projects, Ltd., Ra'anana (IL)

( * ) Notice: Subject to any disclaimer, the term of this patent is extended or adjusted under 35 U.S.C. 154(b) by 0 days.

(21) Appl. No.: 09/370,376

(22) Filed: Aug. 9, 1999

(51) Int. Cl.[7] ..... F04B 1/06
(52) U.S. Cl. ..... 417/219
(58) Field of Search ..... 417/221, 516, 417/517, 538, 466, 530, 515, 469, 417, 410.1, 527, 53

(56) References Cited

U.S. PATENT DOCUMENTS 3,464,359 9/1969 King et al. .
5,044,900 * 9/1991 Cavallaro ..... 417/466
5,069,668 12/1991 Boydman .
5,163,822 * 11/1992 Koelin ..... 417/515
5,277,338 * 1/1994 Divall ..... 417/517

* cited by examiner

*Primary Examiner*—Timothy S. Thorpe
*Assistant Examiner*—William Rodriguez
(74) *Attorney, Agent, or Firm*—James E. Brunton, Esq.

(57) ABSTRACT

An apparatus for moving fluid from a first location to a second location comprises a housing containing a pump body having a central passageway with a fluid inlet and first and second fluid outlets in communication with the passageway. A shuttle having first and second fluid chambers is movable within the passageway of the body between first and second positions. First, second, third, and fourth generally annular shaped fluid passageways provided in the shuttle permit selective fluid communication between the first and second fluid chambers of the shuttle and the inlet and outlet ports of the pump body. First and second inlet passageways provided in the shuttle permits selective fluid communication between the inlet of the pump body and the first and second fluid chambers of the shuttle. A piston is reciprocally movable within the shuttle chambers by a uniquely configured operating mechanism, such as a cam ring. The reciprocation piston functions, not only to control fluid flow through the shuttle, but also functions to move the shuttle between its first and second positions within the central passageway of the pump body.

9 Claims, 7 Drawing Sheets

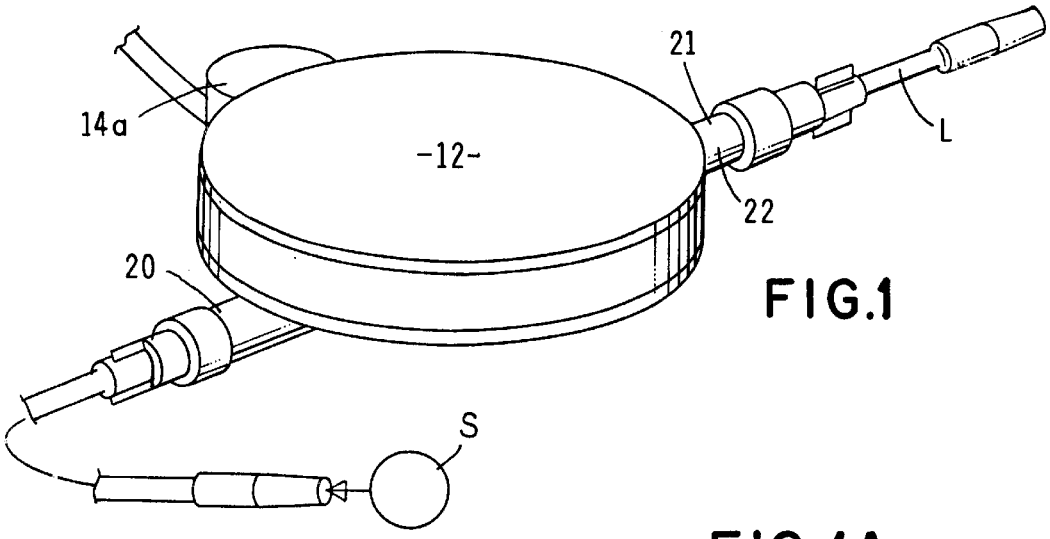
FIG.1
FIG.1A
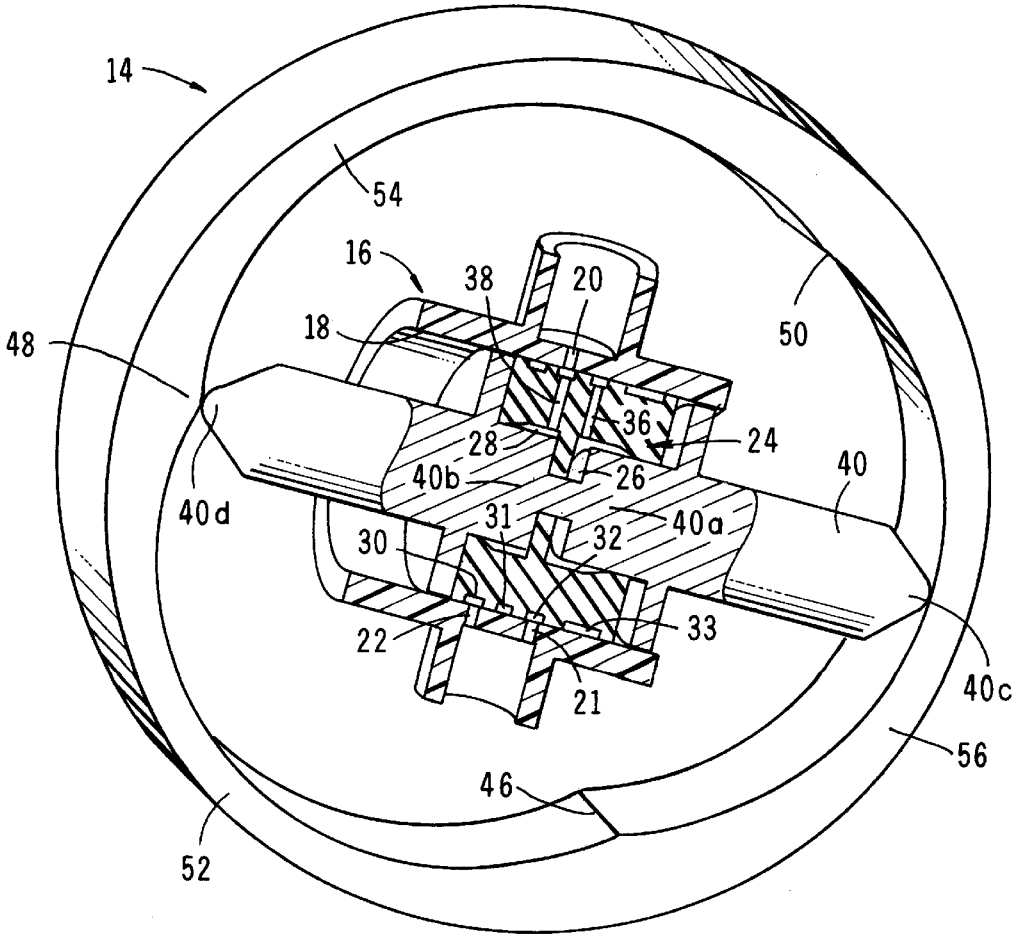

FLUID PUMP

BACKGROUND OF THE INVENTION

1. Field of the Invention

The present invention relates generally to fluid pumps. More particularly, the invention concerns a fluid pump for precisely controlling the transfer of medicaments and other beneficial agents from a source of fluid to a patient.

2. Discussion of the Prior Art

A number of approaches have been suggested in the past for delivering fluid medicaments and other beneficial agents to a patient. The most common apparatus for this purpose is the so-called "gravity feed system". This system involves the use of a flexible bag that is supported above the patient and contains the fluid to be delivered. The fluid is delivered to the patient by force of gravity via a flexible tube that extends between the bag and the patient. The rate of fluid flow to the patient from the bag is basically a function of the amount of restriction of the tube leading to the patient.

To more precisely and reliably control the rate of fluid flow to the patient, several types of devices have been proposed. These devices are generally either mechanical or electronic. Exemplary of one prior art mechanical type delivery device is that described in U. S. Pat. No. 3,464,359 issued to King et al. The King et al device comprises a fluid pump for moving fluid from one system to another under pressure and includes means to assert positive control over the flow rate and also to isolate the outlet of the pump from small quantities of air occurring therein. The device basically comprises a pump body having a central chamber provided with an inlet and an outlet port. Pistons are associated with each port and are movable within the central chamber between a port open and port closed positions. The pistons are constructed and arranged so as to move fluid from one system, through the inlet port of the pump, to the central pump chamber of the pump, toward the outlet port of the pump and then into the second system.

Another prior art mechanical pumping device is disclosed in U.S. Pat. No. 5,163,822 issued to Koelln. The Koelln device comprises a radial piston pump having a pump body with two pump chambers disposed in a straight line. Pistons reciprocate within the pump chambers and are coupled to an actuator that is rotatable about an axis which bisects the straight line and functions to reciprocate the pistons in opposite directions. Each pump chamber is connected to an intake fluid duct and a discharge fluid duct. The inlet ducts are connected to a common main intake duct and the discharge fluid ducts are connected to a common main discharge duct. The actuator controls the operating components of the apparatus and cooperates with the valves thereof, which function to open and close the valve ducts.

In addition to mechanical type pumping devices, a number of different types of micro processor controlled, electronic pumps have been proposed for the controlled delivery of various medicaments to a patient. Exemplary of one prior art pump of this type is that described in U. S. Pat. No. 5,069,668 issued to Boydman. The pump there described is of a character that is capable of receiving a wide variety of commands as by pushing buttons or other controls in conjunction with viewing a changing display of information that is presented on a screen and of carrying out the entered commands as by causing the pumping mechanism to dispense a series of carefully timed, precisely determined quantities of liquid medicine from a reservoir. As a general rule, electronic pumps tend to be complex and are usually quite expensive.

The thrust of the present invention is to provide an elegantly simple fluid pump suitable for the reliable transfer to a patient of liquids such as intravenous solutions and liquid medicaments at precisely controlled flow rates.

SUMMARY OF THE INVENTION

It is an object of the present invention to provide a simple, compact and highly efficient fluid pump for delivering a wide variety of fluids from a fluid source to a remote location as, for example, to a patient at precisely controlled flow rates.

Another object of the invention is to provide an apparatus of the aforementioned character, which is highly reliable in operation and one, which maintains an accurate and stable fluid flow from the source of the fluids to the patient.

Another object of the invention is to provide a pumping apparatus of the character described in the preceding paragraphs in which no valves are required to control fluid flow toward and away from the pumping apparatus.

Another object of the invention is to provide a fluid pump of the class described in which the volume of fluid transferred from the source of fluid to the patient can be varied and closely controlled to enable fluid delivery to the patient at very low flow rates.

Another object of the invention is to provide a fluid pump of the character described in the preceding paragraphs which is made up of relatively few component parts, is economical to manufacture, is easy to use and requires minimum maintenance.

By way of summary, one form of the apparatus of the invention for moving fluid from a first location to a second location comprises a housing containing a pump body having a central passageway with a fluid inlet and first and second fluid outlets in communication with the passageway. A shuttle having first and second fluid chambers is movable within the passageway of the body between first and second positions. First, second, third, and fourth generally annular shaped fluid passageways provided in the shuttle permit selective fluid communication between the first and second fluid chambers of the shuttle and the inlet and outlet ports of the pump body. First and second inlet passageways provided in the shuttle permits selective fluid communication between the inlet of the pump body and the first and second fluid chambers of the shuttle. A piston is reciprocally movable within the shuttle chambers by a uniquely configured operating means, such as a cam ring. The reciprocation piston functions, not only to control fluid flow through the shuttle, but also functions to move the shuttle between its first and second positions within the central passageway of the pump body. With the novel construction thus described, fluid is expelled from the first chamber of the shuttle as the piston moves from a first position toward a second position and, at the same time, fluid is aspirated from the fluid source into the second chamber of the shuttle. During pumping operations, fluid is expelled from the second chamber of the shuttle as the piston moves from the second position toward the first position and fluid is simultaneously aspirated from the fluid source into the first chamber of the shuttle. With this unique arrangement, each movement of the piston permits a precise, known volume of fluid to be expelled from one chamber of the shuttle and at the same time accomplishes the controlled aspiration into the other chamber of a fixed volume of fluid from the fluid source.

BRIEF DESCRIPTION OF THE DRAWINGS

FIG. 1 is a generally perspective view of one form of the basic pump apparatus of the invention for controllably pumping fluid from a source of fluid toward a patient via an administration line.

FIG. 1A is an enlarged, generally perspective view of the operating components of the pumping unit shown in FIG. 1.

DESCRIPTION OF THE INVENTION

Figure 2:
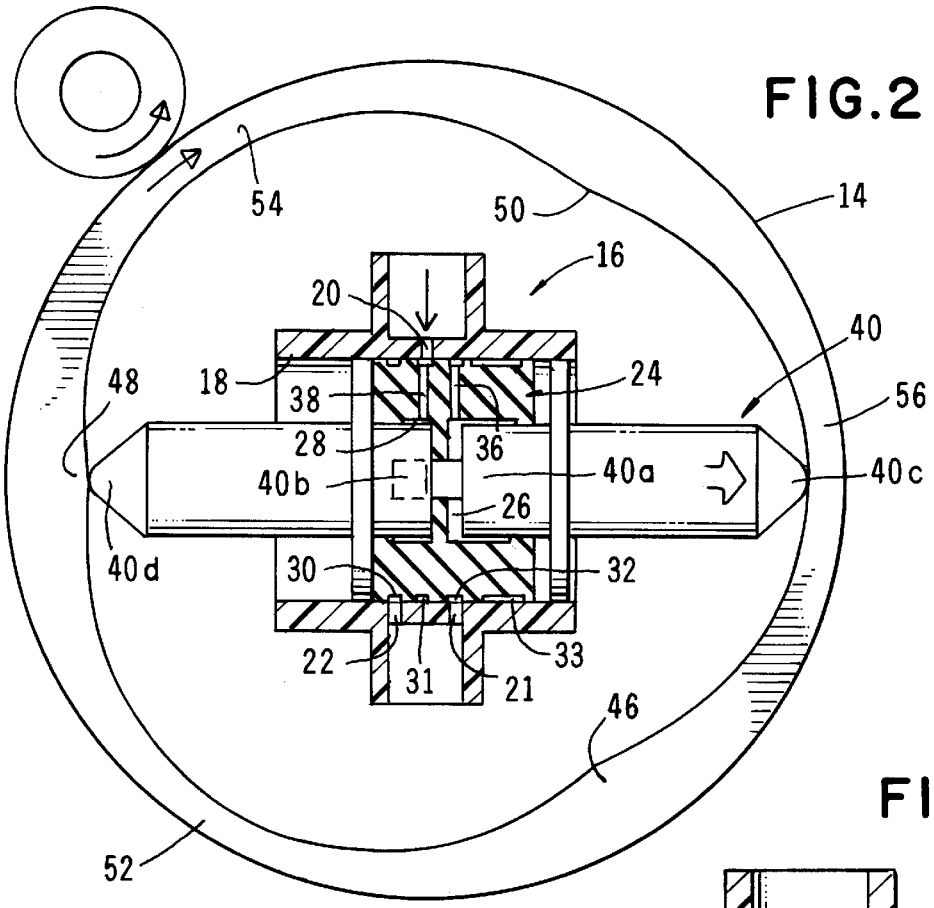
FIG. 2 is a cross-sectional view of the operating components shown in FIG. 1A illustrating the position of the components in a starting configuration.

Referring to the drawings and particularly to FIGS. 1, 1A, and 2, one form of the apparatus of the invention for moving fluids from a first location, such as a fluid source "S" toward a second location, such as an infusion line "L" can be seen to comprises a housing 12 within which is mounted a cam ring 14 and a pump body 16. Pump body 16 has a central passageway 18 provided with an inlet port 20 and spaced apart first and second fluid outlet ports 21 and 22 respectively that are in fluid communication with passageway 18 via a uniquely configured shuttle component 24.

Figure 2A:
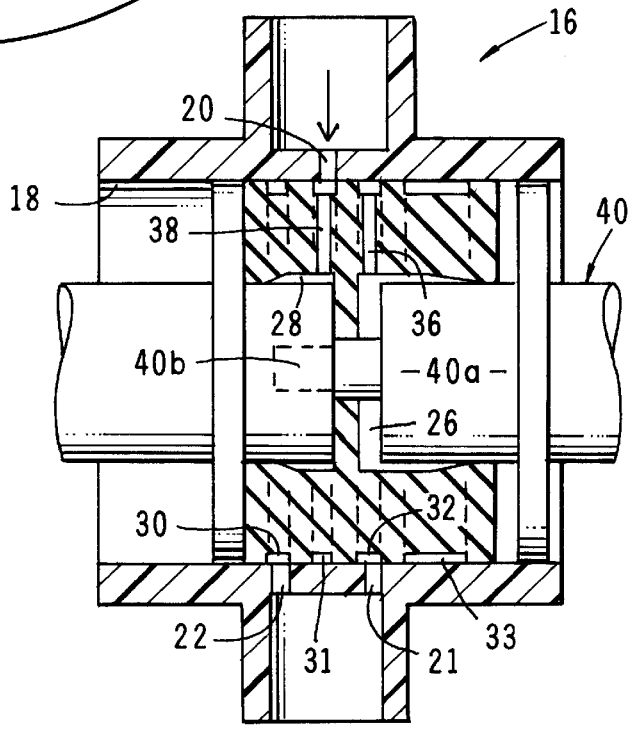
FIG. 2A is an enlarged, fragmentary, cross-sectional view of the control portion of the pumping device.
Figure 2B:
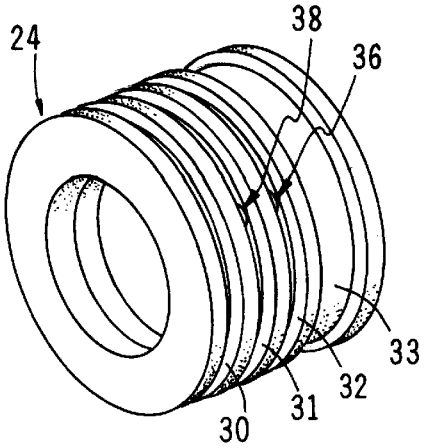
FIG. 2B is a generally perspective view of the shuttle component of the pumping device showing the annular shaped fluid passageways formed therein.
Figure 3:
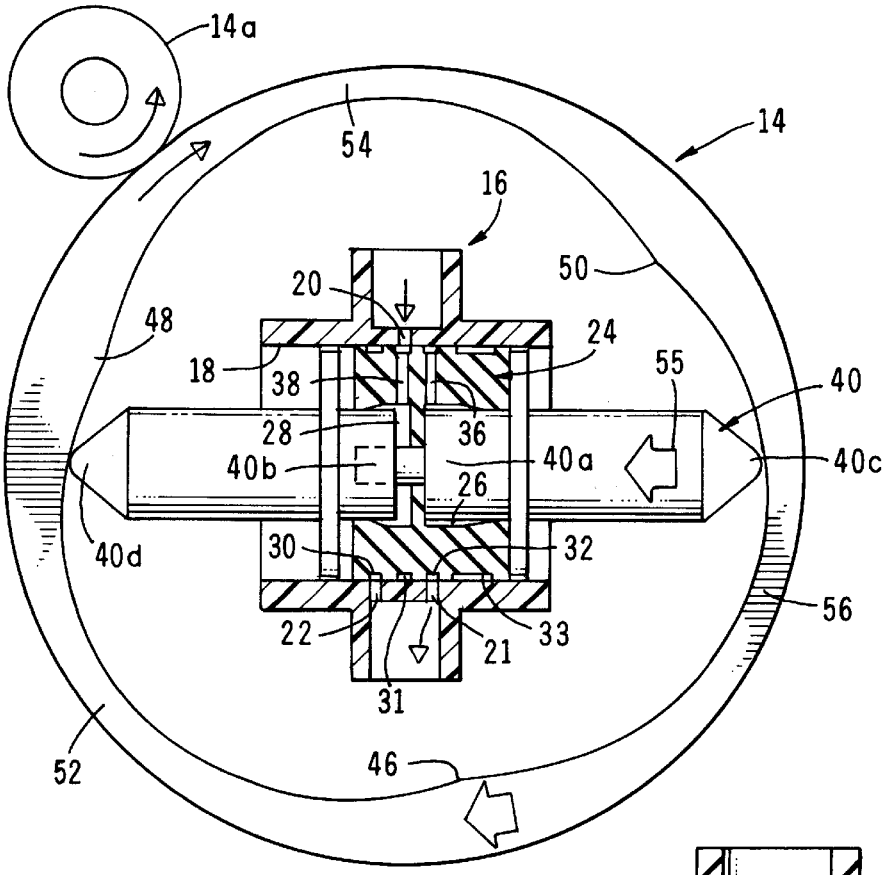
FIG. 3 is a cross-sectional view similar to FIG. 2, but illustrating the position of the components of the apparatus after the piston has been moved from a first position toward a second position.

In a manner presently to be described, shuttle component 24 is movable within central passageway 18 from the first position to a second position. As best seen in FIGS. 2, 2A, and 3 shuttle 24 includes first and second fluid chambers 26 and 28 respectively. Shuttle 24 also includes first, second, third and fourth generally annular shaped fluid passageways 30, 31, 32, and 33 respectively that permit selective fluid communication between first and second chambers 26 and 28 of shuttle 24 and first and second fluid outlet ports 21 and 22 of body 16 (FIG. 2B). Shuttle 24 also includes first and second inlet passageways 36 and 38 which permit fluid communication between first and second fluid chambers 26 and 28 of shuttle 24 and fluid inlet port 20 of body 16. It is to be understood that passageways 36 and 38 are part of their relevant channels and are shown in the upper position only for demonstration and could be at other locations around the circle. Additional passageways could, of course, be provided if desired.

To control fluid flow through the pump and to move shuttle 24 between its first and second positions, a piston 40 is reciprocally movable between first and second positions by a piston operating means, the character of which will presently be described. As best seen in FIGS. 2 and 3, piston 40 has a first portion, generally designated by the numeral 40*a*, that is sealably movable within first chamber 26 of shuttle component 24 and a second portion, generally designated by the numeral 40*b*, that is sealably movable within second fluid chamber 28 of shuttle 24.

In the form of the invention shown in FIGS. 1 through 6, the means for moving piston 40 between its first and second position comprises the previously identified cam ring 14 which is of the general configuration best seen in FIG. 2. Cam ring 14 is controllably rotated in either a clockwise or counterclockwise direction by a driving means shown here as a drive wheel 14*a* (FIG. 2) which can be rotated by an electric motor or other mechanical means well known to those skilled in the art. Cam ring 14 here comprises three circumferentially spaced-apart cam lobes or protuberances 46, 48, and 50. Disposed between protuberances 46 and 48 is a segment 52 of varying wall thickness. Similarly, a segment 54 of varying wall thickness is disposed between protuberances 48 and 50 and a segment 56 of varying wall thickness is disposed between protuberances 50 and 46. As indicated in FIGS. 2 through 6, the ends 40*c* and 40*d* of piston 40 are always maintained in contact with the cam ring as the cam ring is rotated through an arc of 360 degrees. More particularly, when the apparatus is in the position shown in FIG. 2, end 40*c* of piston 40 is in engagement with varying wall thickness segment 56 while end 40*d* of the piston is in engagement with protuberance 48.

Figure 3A:
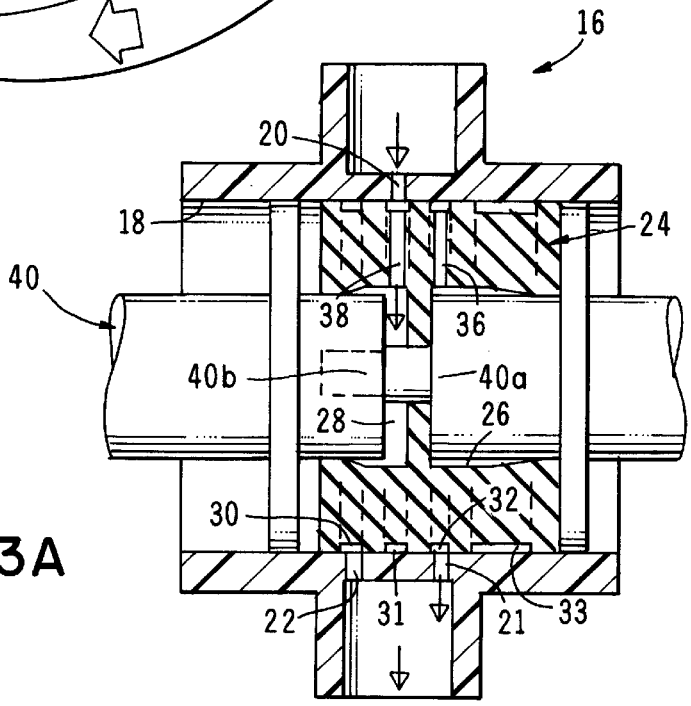
FIG. 3A is an enlarged, fragmentary, cross-sectional view of the central portion of the device as it appears in FIG. 3.
Figure 4:
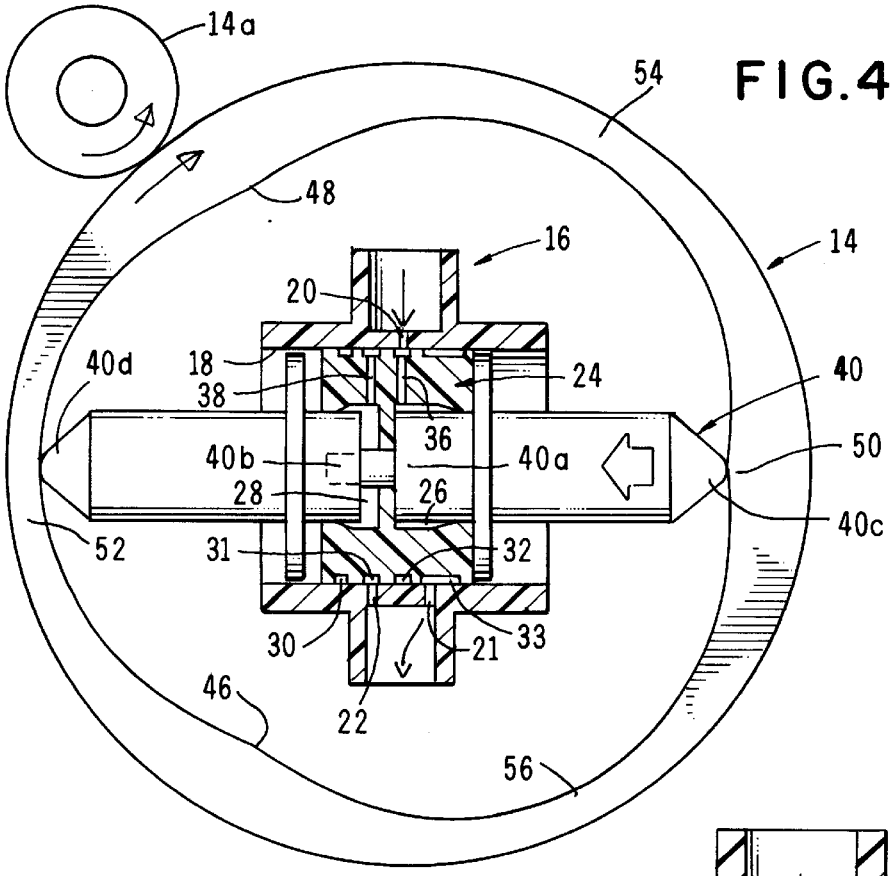
FIG. 4 is a cross-sectional view similar to FIG. 3, but showing a further movement of the piston toward the second position to cause the shuttle to move from the first position shown in FIGS. 2 and 3 to the position shown in FIG. 4.
Figure 4A:
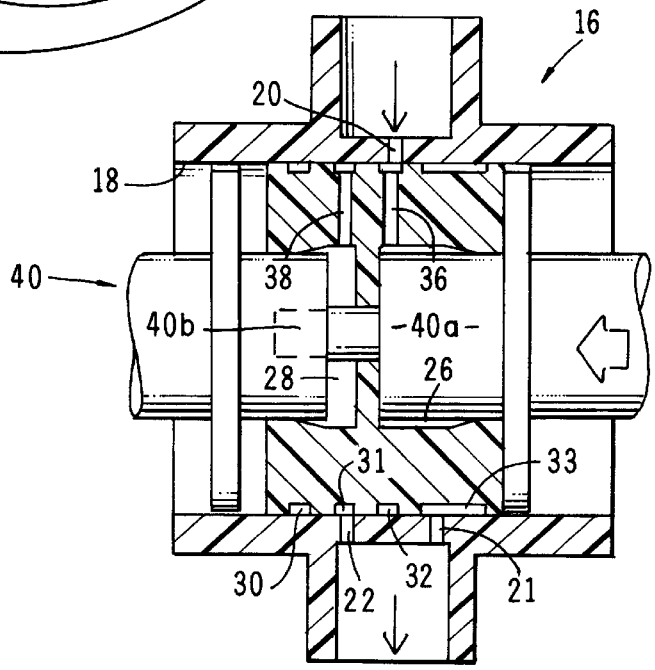
FIG. 4A is an enlarged, fragmentary, cross-sectional view of the central portion of the device as it appears in FIG. 4.

It is to be noted that when the piston is in the position shown in FIGS. 2 and 2A, shuttle 24 is in its first position. Rotation of cam ring 14 into the position shown in FIG. 3 and 3A will cause increasing wall thickness segment 56 to move the piston toward the left in the direction of arrow 55 causing fluid to be expelled from first chamber 26 via fluid passageways 32 and 36 of the shuttle and first outlet port 21 of the pump body. At the same time, due to the suction of portion 40*b* of piston 40 as it moves within chamber 28, fluid will be aspirated into second chamber 28 via inlet port 20 of pump body 16 and fluid passageways 31 and 38 of shuttle 24 (FIG. 3). Continued movement of the piston to the left by protuberance 50 into the position shown in FIGS. 4 and 4A will cause shuttle 24 to be shifted to the left to the second position shown in FIGS. 4 and 4A. In this second position shuttle inlet 36 is in communication with pump body inlet port 20 and shuttle fluid passageway 31 is in communication with pump outlet port 22.

Figure 5:
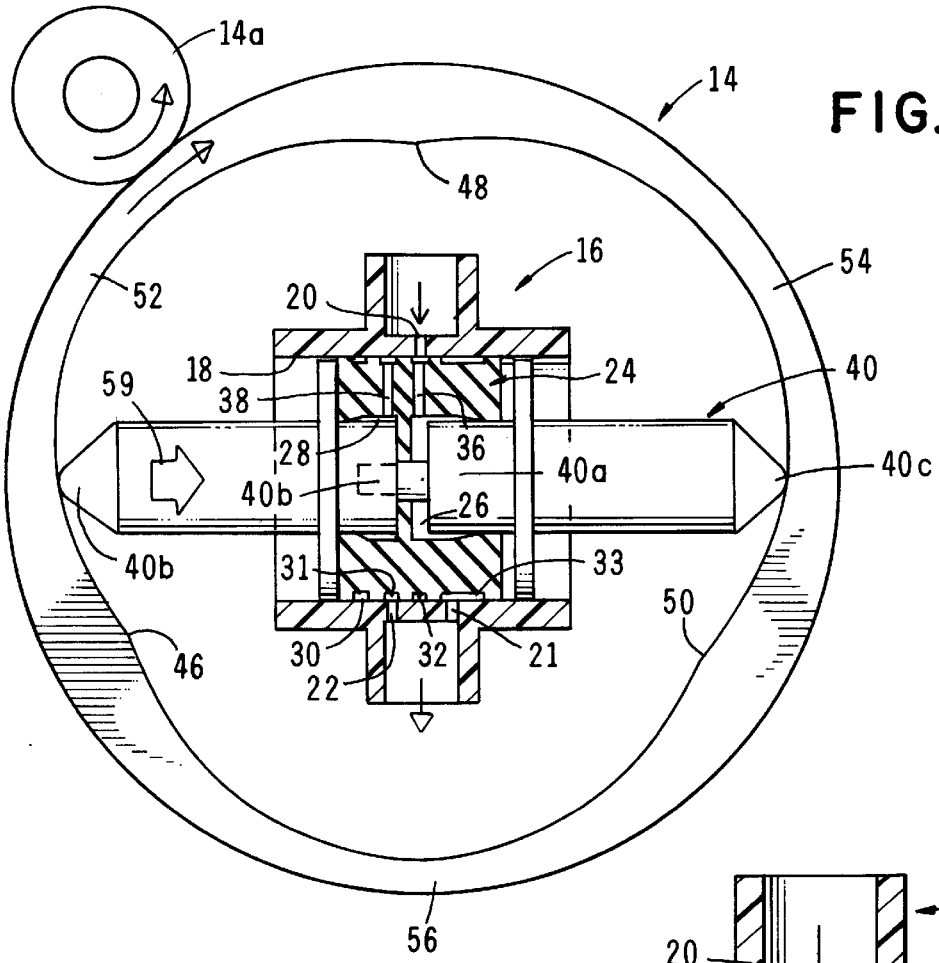
FIG. 5 is a cross-sectional view similar to FIG. 4, but showing movement of the piston in an opposite direction toward the first starting position.
Figure 5A:
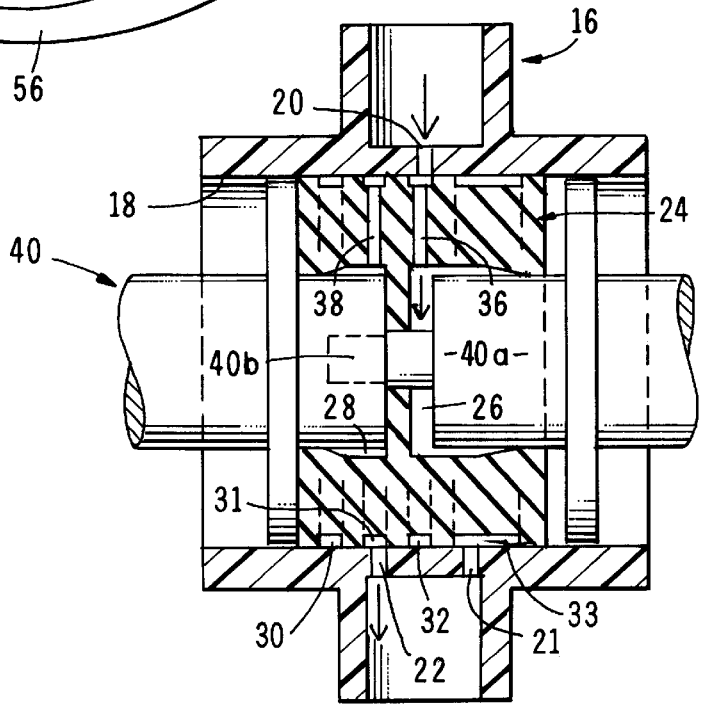
FIG. 5A is an enlarged, fragmentary, cross-sectional view of the central portion of the device as it appears in FIG. 5.

As cam ring 14 continues to rotate, piston 40 will be urged to the right by the increasing wall thickness of segment 52 into the position shown in FIGS. 5 and 5A causing fluid to be urged outwardly of chamber 28 through shuttle fluid passageway 31 and into second pump outlet port 21. At the same time, due to the suction caused by the movement of portion 40*a* of piston 40 within chamber 26, fluid will be aspirated into chamber 26 via pump inlet 20. Continued movement of piston 40 to the right by protuberance 46 in the direction of the arrows 59 in FIGS. 5 and 6, will cause shuttle component 24 to move into the original starting position shown in FIGS. 2 and 2A. In this position shuttle outlet 32 is once again aligned with first pump outlet port 21.

As cam ring 14 is further rotated in a clockwise direction, increasing wall thickness segment 54 will once move urge piston 40 to the left causing fluid to be expelled from chamber 26 and simultaneously aspirated into chamber 28. As the cam ring 14 continues to rotate, it is apparent that the pumping cycle will continue in the manner described in the preceding paragraphs.

Figure 6:
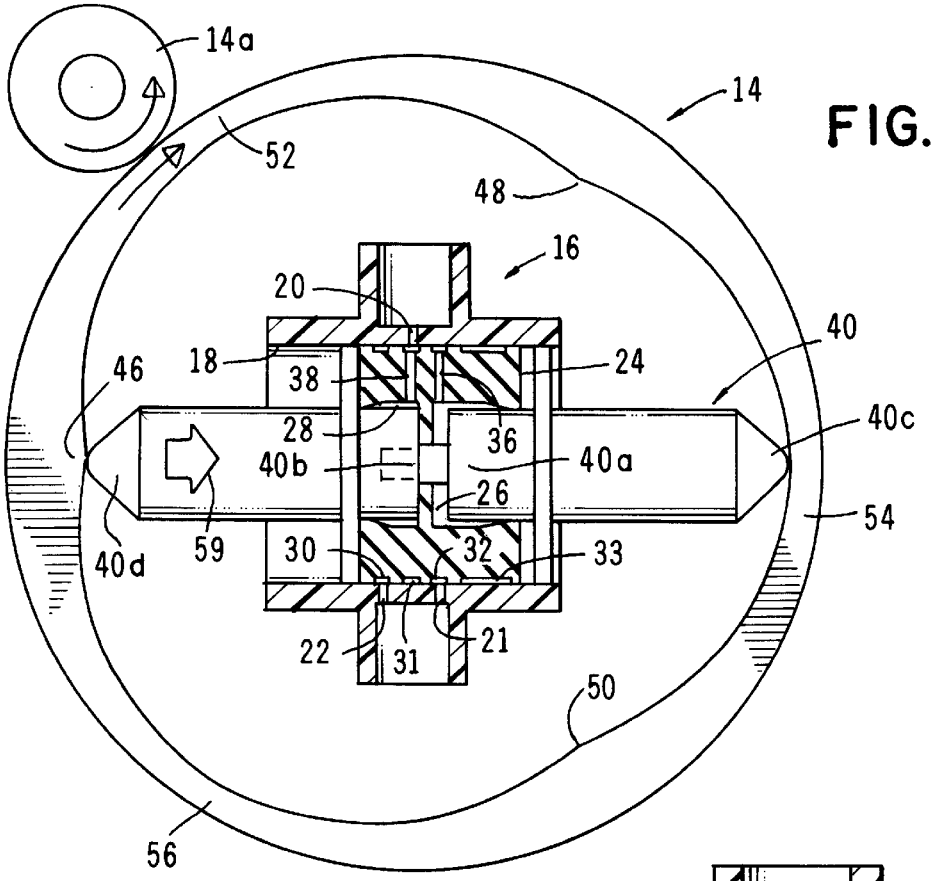
FIG. 6 is a cross-sectional view similar to FIG. 5, but showing further movement of the piston to the right to cause the shuttle to return to its first starting position.
Figure 6A:
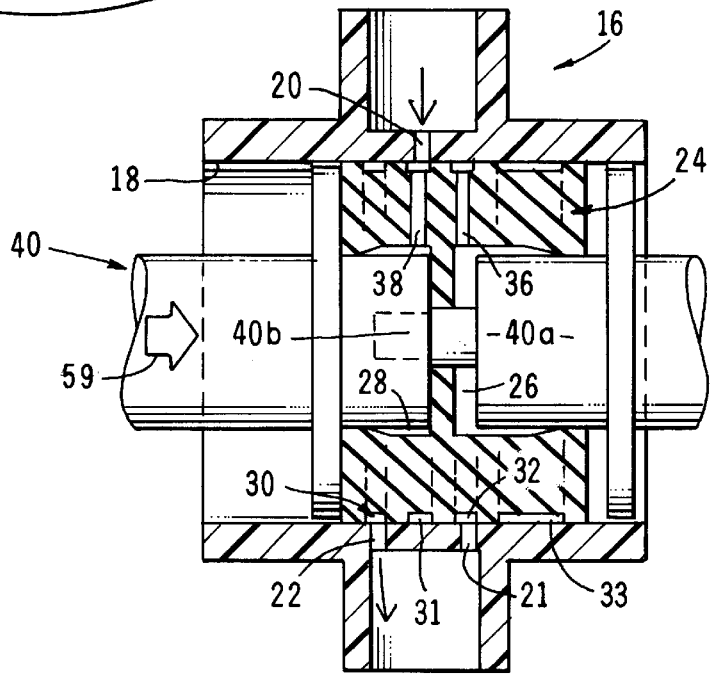
FIG. 6A is an enlarged fragmentary, cross-sectional view of the central portion of the device as it appears in FIG. 6.
Figure 6B:
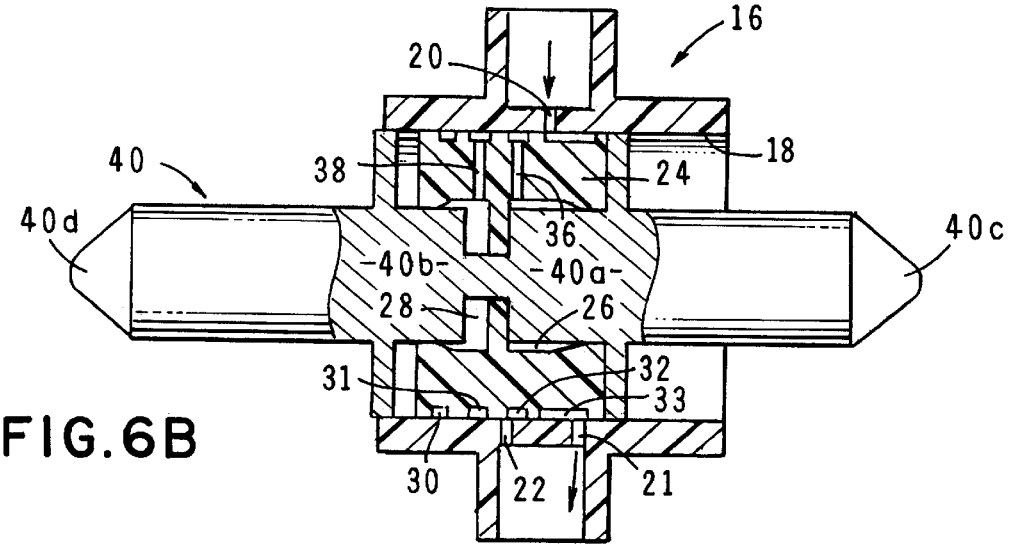
FIG. 6B is an enlarged, fragmentary, cross-sectional view of the pumping components of the apparatus in a pump priming position.

Turning next to FIG. 6B, an alternate form of the pumping apparatus is there shown. In this alternate form, the piston driving means is constructed and arranged so that the shuttle 24 can be moved into the third position shown in FIG. 6B wherein outlet passageway 33 of the shuttle is in communication with inlet port 20 of the pump body and is also in communication with outlet port 21 of the pump body. With the components of the device in this position, fluid can flow directly from the inlet port of body 16 to the outlet port via flow passageway 33 to enable expeditious initial priming of the pump as may be necessary.

Figure 7:
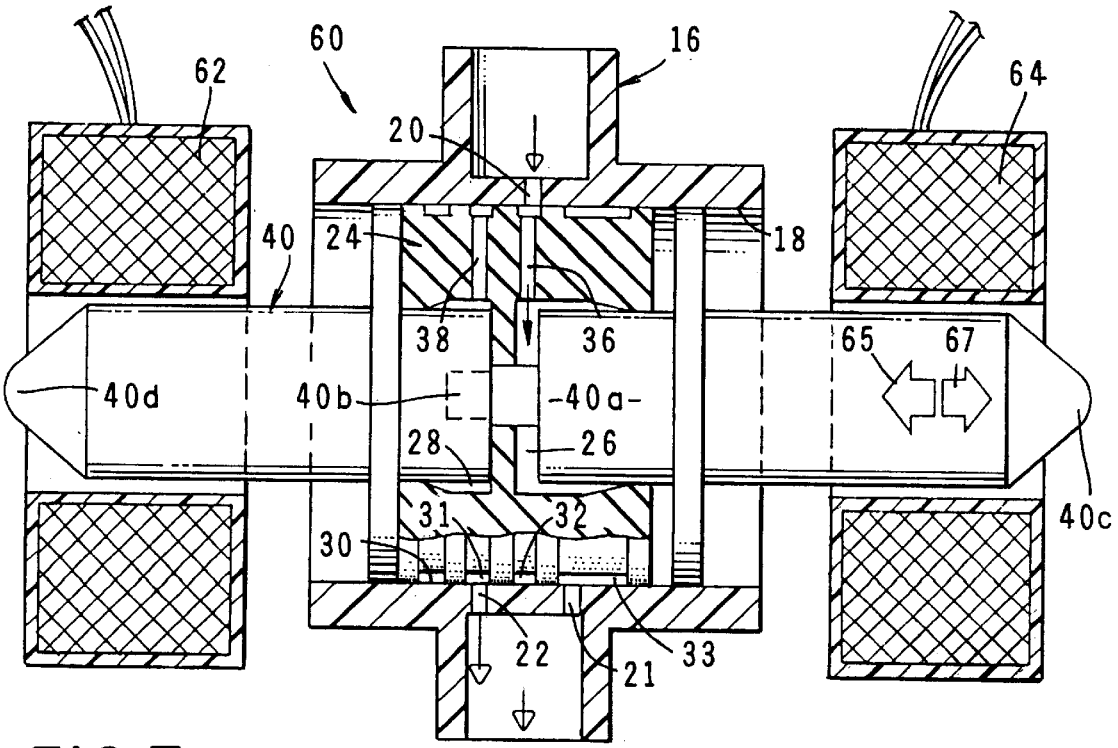
FIG. 7 is a side-elevational, cross-sectional view of an alternate form of pumping apparatus of the present invention.

Referring finally to FIG. 7, still another embodiment of the apparatus of the invention is there shown and generally identified by the numeral 60. This embodiment is similar in many respects to that shown in FIGS. 1 through 6 and once again like numbers are used to identify like components. The principal difference between this last form of the invention and those earlier described resides in the provision of a different piston driving means for reciprocating piston 40. More particularly, as shown in FIG. 7, the cam ring has been replaced by a pair of solenoids 62 and 64. Solenoids 62 and 64 are of a conventional construction well known to those skilled in the art and can be alternately energized to cause the reciprocating movement of piston 40 as indicated by the arrows 65 and 67. Using the solenoids in this way, piston 40 and, in turn, shuttle 24 can be moved through the pumping cycle as earlier discussed herein. It is to be noted that this alternate piston driving means can be used to drive the piston in the various manners indicated in FIGS. 1 through 6 as well as into the priming position shown in FIG. 6B. Additionally, it is to be understood that other types of mechanical and electromechanical means well known to those skilled in the art can be used to appropriately drive the piston 40.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention as set forth in the following claims.

I claim:

1. An apparatus for moving fluid from a source of fluid to a location remote from the source of fluid comprising:

(a) a body having a passageway and a fluid inlet and first and second fluid outlets in communication with said passageway, said fluid inlet being in communication with the source of fluid and said first and second fluid outlets being in communication with the location remote from the source of fluid;

(b) a shuttle movable within said passageway of said body between a first position within said passageway, and a second position within said passageway, said shuttle having first and second fluid chambers and including:

(i) an outlet passageway permitting fluid communication between said first fluid chamber and said first fluid outlet port of said body upon said shuttle moving to said first position;

(ii) another outlet passageway permitting fluid communication between said second fluid chamber and said second fluid outlet port of said body upon said shuttle moving to said second position;

(iii) an inlet passageway permitting fluid communication between said second fluid chamber and said fluid inlet port of said body upon said shuttle moving to said first position; and (iv) another inlet passageway permitting fluid communication between said first fluid chamber and said fluid inlet port of said body upon said shuttle moving to said second position; and (c) a piston reciprocally movable within said shuttle between first and second positions.

2. The apparatus as defined in claim 1 in which said shuttle is moved within said passageway of said body between said first and second positions by said piston.

3. The apparatus as defined in claim 1 further including means for moving said piston between said first and second positions.

4. The apparatus as defined in claim 3 in which said means for moving said piston between said first and second positions comprises a rotatable cam ring.

5. The apparatus as defined in claim 3 in which said means for moving said piston between said first and second positions comprises a pair of solenoids.

6. An apparatus for moving fluid from a source of fluid to an infusion line comprising:

(a) a body having a passageway and a fluid inlet and first and second fluid outlets in communication with said passageway, said fluid inlet being in communication with said source of fluid and said first and second fluid outlets being in communication with said infusion line;

(b) a shuttle movable within said passageway of said body between a first location within said passageway and a second location within said passageway, said shuttle having first and second fluid chambers and including:

(i) an outlet permitting fluid communication between said first fluid chamber and said first fluid outlet port of said body upon said shuttle moving to said first position;

(ii) another outlet permitting fluid between said second fluid chamber and said second fluid outlet port of said body upon said shuttle moving to said second position;

(iii) an inlet permitting fluid communication between said second fluid chamber and said fluid inlet port of said body upon said shuttle moving to said first position; and (iv) another inlet permitting fluid communication between said first fluid chamber and said fluid inlet port of said body upon said shuttle moving to said second position;

(c) a piston reciprocally movable within said shuttle between first and second positions, said piston moving said shuttle between said first and second positions as said piston moves between said first and second positions; and (d) means for moving said piston between said first and second positions, said means comprising a cam ring.

7. The apparatus as defined in claim 6 in which said cam ring comprises a generally ring shaped body having an inner surface said surface having three circumferentially spaced piston engaging protuberances.

8. A method for moving fluid from a source of fluid to a second location remote from said source of fluid using an apparatus comprising a body having a central passageway and a fluid inlet port and first and second fluid outlet ports in communication with the central passageway, the fluid inlet port being in communication with the source of fluid and the first and second fluid outlet ports being in communication with the second location remote from the source of fluid; a shuttle movable within the passageway of the body between a first position within the passageway and a second, position within the passageway, the shuttle having first and second chambers and including first and third fluid passageways and first and second inlets and a piston reciprocally movable within the shuttle; the method comprising the steps of:

(a) moving the piston within the first fluid chamber of the shuttle to force fluid therefrom into the first fluid outlet port of the body via one of the first and second passageways of the shuttle and to simultaneously cause fluid to be aspirated into the second fluid chamber of the shuttle via the fluid inlet port of the body and one of the first and second inlets of the shuttle;

(b) moving the piston to move the shuttle from a first location wherein the second inlet of the shuttle is in index with the fluid inlet port of the body to a second location wherein the first inlet of the shuttle in is index with the fluid inlet port of the body;

(c) moving the piston within the second fluid chamber of the shuttle to force the fluid aspirated therein to flow from the second fluid chamber into the second fluid outlet port of the body via the other of said first and second passageways of the shuttle and simultaneously to cause fluid to be aspirated into the first fluid chamber of the shuttle via the fluid inlet port of the body and one of the first and second inlets of the shuttle; and (d) moving the piston to move the shuttle from the second location to the first location.

9. The method as defined in claim 8 in which the shuttle includes a fourth fluid passageway and in which the method includes the step of moving the shuttle to a third position wherein the first inlet port of the body is in communication with one of the first and second outlet ports of the body via the fourth fluid passageway.

* * * * *